US005772129A

United States Patent [19]

Nishio et al.

[11] Patent Number: 5,772,129

[45] Date of Patent: Jun. 30, 1998

[54] PROCESS AND APPARATUS FOR CONTROLLING THE CUTTER OF A SHREDDER

[75] Inventors: Tatsuo Nishio, Okazaki; Hirotaka Iwata, Aichi-ken, both of Japan

[73] Assignee: Ricoh Elemex Corporation, Aichi-ken, Japan

[21] Appl. No.: 791,980

[22] Filed: Jan. 31, 1997

Related U.S. Application Data

[62] Division of Ser. No. 520,766, Aug. 30, 1995, Pat. No. 5,662,280.

[30] Foreign Application Priority Data

Aug. 31, 1994 [JP] Japan ..... 6-230553
Jul. 13, 1995 [JP] Japan ..... 7-200418

[51] Int. Cl.[6] ..... B02C 25/00

[52] U.S. Cl. ..... 241/30; 241/34; 241/36

[58] Field of Search ..... 241/34, 36, 100, 241/30, 236; 271/35, 110, 127, 265.01, 111, 266, 114, 265.02; 83/734

[56] References Cited

U.S. PATENT DOCUMENTS 4,986,481 1/1991 Fujii et al. ..... 241/36 X
5,009,410 4/1991 Fujii et al. ..... 271/127
5,167,374 12/1992 Strohmeyer ..... 241/34 X

FOREIGN PATENT DOCUMENTS 0244850 11/1987 European Pat. Off. .
0374481 6/1990 European Pat. Off. .
7-81791 3/1995 Japan .
7-109036 4/1995 Japan .
7-117882 5/1995 Japan .
2209963 1/1989 United Kingdom ..... 241/34

*Primary Examiner*—Mark Rosenbaum
*Attorney, Agent, or Firm*—Spencer & Frank

[57] ABSTRACT

A paper feed device is mounted to a shredder. The intermittent activation time of paper feeding is adjusted, taking into consideration of the distance from the paper feed start position to the paper shredding position of a cutter of the shredder, thereby decreasing the speed of travel from the time the paper sensor detects the leading edge of the paper to the time the paper reaches the paper shredding position, so that operation is switched from intermittent to continuous activation preferably immediately before the leading edge of the paper reaches the cutter. Thus paper feed troubles associated with conventional devices are prevented, due to paper jamming, etc., caused by bending of the paper, etc.

3 Claims, 14 Drawing Sheets

| NO. OF INTERMITTENT ACTIVATION | SWITCH NO. | | | | | | | |
|---|---|---|---|---|---|---|---|---|
| | 1 | 2 | 3 | 4 | 5 | 6 | 7 | 8 |
| 0 | 0 | 0 | 0 | 0 | — | — | — | — |
| 1 | 1 | 0 | 0 | 0 | — | — | — | — |
| 2 | 0 | 1 | 0 | 0 | — | — | — | — |
| 3 | 1 | 1 | 0 | 0 | — | — | — | — |
| 4 | 0 | 0 | 1 | 0 | — | — | — | — |
| 5 | 1 | 0 | 1 | 0 | — | — | — | — |
| 6 | 0 | 1 | 1 | 0 | — | — | — | — |
| 7 | 1 | 1 | 1 | 0 | — | — | — | — |
| 8 | 0 | 0 | 0 | 1 | — | — | — | — |
| 9 | 1 | 0 | 0 | 1 | — | — | — | — |
| 10 | 0 | 1 | 0 | 1 | — | — | — | — |
| 11 | 1 | 1 | 0 | 1 | — | — | — | — |
| 12 | 0 | 0 | 1 | 1 | — | — | — | — |
| 13 | 1 | 0 | 1 | 1 | — | — | — | — |
| 14 | 0 | 1 | 1 | 1 | — | — | — | — |
| 15 | 1 | 1 | 1 | 1 | — | — | — | — |

1 : ON 0 : OFF — : ON OR OFF $I_1$ = CONSUMED CURRENT(PRIMARY CURRENT)

$I_2$ = OUTPUT CURRENT $N_1$ = PRIMARY WINDING $N_2$ = SECONDARY WINDING $V_2$ = OUTPUT VOLTAGE(SECONDARY VOLTAGE)

R1 = RESISTANCE

Ith = CONSUMED CURRENT THRESHOLD BETWEEN CUTTER ACTIVATION AND COMPRESSION

I'th = CONSUMED CURRENT THRESHOLD BETWEEN COMPRESSION AND DEACTIVATION $V_2$ = OUTPUT VOLTAGE AT ITH $V'_2$ = OUTPUT VOLTAGE AT I'TH

FIG.13A

| SHREDDER MODE | CONSUMED CURRENT |
|---|---|
| CUTTER ACTIVATION | 4.7A / 2.3A |
| COMPRESSION | 0.5A / 0.5A |
| DEACTIVATION | 0.05A / 0.05A |

FIG.13B

| SHREDDER MODE | CONSUMED CURRENT |
|---|---|
| CUTTER ACTIVATION | 1.2A OR HIGHER |
| COMPRESSION | 0.2A TO 1.2A |
| DEACTIVATION | UNDER 0.2A |

PRIOR ART

PROCESS AND APPARATUS FOR CONTROLLING THE CUTTER OF A SHREDDER

This is a division of application Ser. No. 08/520,766, filed Aug. 30, 1995 now U.S. Pat. No. 5,662,280.

BACKGROUND OF THE INVENTION

1. Field of the Invention

This invention relates to a shredder of a type in which a fed paper is detected by a paper detection sensor and a cutter is activated accordingly, thereby shredding the paper with the cutter. The invention relates more particularly to a paper feed device for shredders, and to a method of feeding papers using such paper feed device for shredders, the paper feed device being mounted on such a shredder and activated by, for instance, depressing a start switch or other means after disposable papers are loaded and set in place in the paper feed device. Thus the papers are automatically fed into the shredder with the paper feed device.

2. Description of the Related Art

There have conventionally been shredders of the type having a slot through which disposable papers are fed and a paper is detected by a paper detection sensor when it passes the paper feed passage, and a cutter is thereby activated and shreds the paper.

To feed a paper automatically into such type of shredders, a paper feed device is mounted over the shredder and activated by, for instance, depressing a start switch or other means after disposable papers are loaded and set in place, and the papers are fed sequentially into the shredder slot using a paper feed mechanism consisting of a feed belt, etc.

For instance, a paper feed device 2 is mounted on a shredder 1 as shown in FIG. 15. The paper feed device 2 is provided with a tray 2*b* placed over a main body 2*a* in an inclined position with its right-hand side being higher than the left-hand side as illustrated in the figure, and a feed belt 3 is passed around pulleys 4 and 5 along the inclination of the tray 2*b*. On the other hand, a pair of paper guides 1*b*,1*b* are provided from a paper slot la towards a cutter 6, and a paper detection sensor 7 is provided at the position facing a paper feed passage 1*c* formed between the feed guides 1*b*,1*b*.

When in use, disposable papers P are set in place on the tray 2*b* of the paper feed device 2, and the paper feed device 2 is started to move by, for instance, depressing a start switch, thereby activating feed belt 3 by a paper feed motor 8 to feed disposable papers P, a sheet at a time, from the bottom of the pile, through feed passage 9 and into paper feed passage 1*c* of the shredder 1. The leading end of the fed paper is detected by the paper detection sensor 7 and the cutter 6 is activated accordingly, thereby shredding paper with the cutter 6.

In such type of shredder 1, however, a design requirement to keep it as compact as possible prohibits the paper detection sensor 7 to be located sufficiently away from the cutter 6. For this reason, the leading end of a paper sometimes reaches the cutter 6 before it is fully activated. This causes paper P to bend or curl, and it may result in paper jamming and other paper feeding troubles.

An objective of this invention is therefore to eliminate these drawbacks seen in the conventional devices, thereby providing a paper feed device for shredders, free from paper feeding troubles, and a method of feeding papers using such a device.

SUMMARY OF THE INVENTION

The paper feed device for shredders according to one aspect of the present invention is mounted to the shredder 10 of the type which detects the fed paper by a paper detection sensor 56, activates the cutter 11, and shreds the paper using the cutter 11. The paper feed device is activated, after disposable papers P are loaded and set in place, sequentially feeds the papers P to the shredder 10 using a paper feed mechanism 20, and has a number of features including an intermittent activation time adjustment means for adjusting the intermittent activation time of the paper feed mechanism 20 when the device is mounted to the shredder, taking into consideration the distance from the paper feed start position b of the paper feed mechanism 20 to the paper shredding position a of the cutter 11, and an activation control means that first intermittently activates the paper feed mechanism 20 and then switches and activates the paper feed mechanism continuously after an elapse of time adjusted by the intermittent activation time adjustment means. The paper feed device for shredders according to the one aspect of the present invention uses a DIP switch 70 as the intermittent activation time adjustment means, which intermittently activates the paper feed mechanism 20 for a number of times set by the DIP switch 70, thereby adjusting the intermittent activation time of the paper feed mechanism 20.

The paper feed method by a paper feed device for shredders according to the one aspect of the present invention is one in which a paper feed device 12 is mounted to the shredder 10 for automatically feeding disposable papers P to the paper feed device, the intermittent activation time adjustment means installed in the paper feed device 12 is adjusted according to the distance from the paper feed start position b of the paper feed mechanism 20 of the paper feed device 12 to the paper shredding position a by the cutter 11 of the shredder 10, then, disposable papers P are loaded and set in place in the paper feed device 12, then the paper feed device 12 is activated and the paper feed mechanism 20 is activated intermittently by the activation control means thereof to sequentially feed the disposable papers P to the shredder 10 using the paper feed mechanism 20, and, then the paper feed device is switched, after an elapse of time adjusted by the intermittent activation time adjustment means, to continuously activate the paper feed mechanism 20 by the activation control means, thereby continuously feeding the disposable papers P sequentially to the the shredder 10 using the paper feed mechanism 20.

The paper feed device for shredders according to another aspect of the present invention which is mounted to the shredder 10 of the type whose paper detection sensor 56 detects the fed papers and activates the cutter 11 that shreds the papers, is activated after disposable papers P are loaded and set in place and feeds the papers sequentially to the shredder 10 using the paper feed mechanism 20, the device being equipped with a cutter activation detection means that detects activation of the cutter 11 and an activation control means that first intermittently activates the paper feed mechanism 20 and then switches and activates the paper feed mechanism 20 continuously when activation of the cutter 11 is detected by the cutter activation detection means.

The paper feed device for shredders according to the second aspect of the present invention has a plug socket 50 for a shredder that supplies electricity to the shredder 10, and equipped with an electric current detection sensor 51, as means to detect activation of the cutter, which detects the current consumption by way of the plug socket 50 for the shredder.

The paper feed method by a paper feed device for shredders according to the another aspect of the present invention is one in which the paper feed device 12 is mounted to the shredder 10 for automatically feeding disposable papers P thereto, then, disposable papers P are loaded and set in place in the paper feed device 12, then, the paper feed device 12 is activated and the paper feed mechanism 20 is activated intermittently by the activation control means thereof and the the disposable papers P are fed intermittently to the shredder 10 using that paper feed mechanism 20, then, when the fed paper P is detected by the paper detection sensor 56 of the shredder 10 and the cutter 11 of the shredder 10 is activated, activation of the cutter 11 is detected by the cutter activation detection means of the paper feed device 12, and, further, the paper feed device is switched when the activation of the cutter 11 is detected by the cutter activation detection means to continuously activate the paper feed mechanism 20 using the activation control means, thereby continuously feeding the disposable papers P sequentially to the the shredder 10.

According to the present invention, when the paper feed device 12 is mounted to a specific shredder 10, the intermittent activation time adjustment means is adjusted, taking into consideration the distance from the paper feed start position b of the paper feed mechanism 20 of the paper feed device 12 to the paper shredding position a of the cutter 11 of the shredder 10, and, after an elapse of time as adjusted by the intermittent activation time adjustment means, activation of the paper feed mechanism 20 by the activation control means is switched from intermittent to continuous activation preferably immediately before the leading edge of the paper reaches the cutter 11 of the shredder 10.

According to the another aspect of the present invention, when activation of the cutter 11 is detected by the cutter activation detection means, activation of the paper feed mechanism 20 by the activation control means is switched from intermittent to continuous activation preferably immediately before the leading edge of the paper reaches the cutter 11 of the shredder 10.

BRIEF DESCRIPTION OF THE DRAWINGS

FIG. 13A is a table showing electric currents consumed by the shredder during the cutter is driven, shred compression, and cutter deactivation.

FIG. 13B is a table showing the threshold values for those conditions.

DESCRIPTION OF THE PREFERRED EMBODIMENTS

PREFERRED EMBODIMENTS

Preferred embodiments of the present invention are explained below with reference to the attached drawings.

Figure 1:
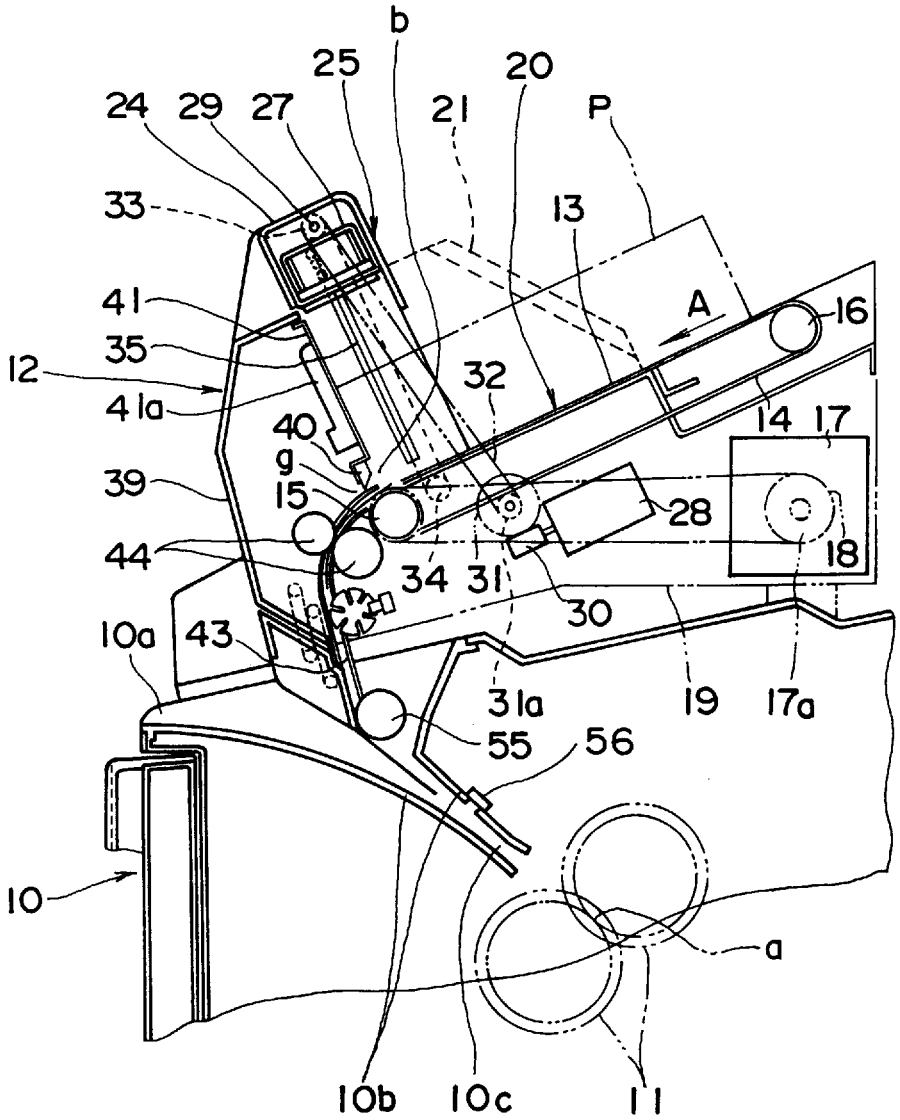
FIG. 1 is a schematic view showing an inner mechanism of a shredder on which an embodiment of a paper feed device according to the present invention is mounted.

FIG. 1 is a schematic diagram showing the inner mechanism at the top of a shredder to which a paper feed device according to the present invention is mounted. In the figure, numeral 10 indicates a shredder. The shredder 10 is of an oblong box shape having a hand-fed paper feed slot 10*a* in the upper left side thereof in the figure, and a pair of feed guides 10*b*,10*b* are positioned diagonally downward to right from the paper feed slot 10*a*, thus forming a paper feed passage 10*c* between the pair of feed guides 10*b*,10*b*. A paper detection sensor 56 is put near the paper feed passage 1O*c* and facing it. Further, a cutter 11 is provided at an end of the paper feed passage 10*c*, and the cutter 11 is activated when the leading end of the paper, fed from the paper feed slot 10*a*, is detected by the paper detection sensor 56, so that the paper is shredded at the paper shredding position a where the teeth of the cutter 11 mesh each other to shred.

A paper feed device 12 is mounted at the top portion of the shredder 10. It should be understood that the paper feed device 12 is designed in such a way it can be installed in shredders of several models, and it automatically feeds disposable papers into the shredder on which it is mounted. The paper feed device 12 shown in the figure has a tray 13 at the top, as well shown in FIG. 2, and mounted in an inclination of approximately 30° with the front (left-hand side in FIG. 1) being lower than the rear (right-hand side in FIG. 1), while opposing side plates 13*a*, 13*b* are located at both sides of the tray 13. In the tray 13 plural feed belts 14 are provided in the paper feed direction A. The feed belts 14, as shown in FIG. 1, are passed around pulleys 15, 16. A paper feed motor 17 is installed under the rear pulley 16. A pulley 18 is mounted to a drive shaft 17*a* of the paper feed motor 17. Furthermore, a transmission belt 19 is passed around the pulley 18 and another pulley (not shown) mounted to the shaft of the front pulley 15 nearly in a horizontal position. Thus, a paper feed mechanism 20 is formed comprising the paper feed motor 17, feed belts 14, pulleys 15,16,18, transmission belt 19, and others.

The paper feed device has a pair of side guides 21*a*, 21*b* on the tray 13 facing each other to regulate the loaded position of the disposable papers P. The side guides 21*a*, 21*b* are linked to be movable together in parallel and crosswise direction with respect to the paper feed direction A, so that the distance between the two side guides 21 can be adjusted according to the paper size.

Further, the paper feed device 12 has a cover portion 24 having a shape of an oblong box and positioned over and between the opposing side plates 13*a*, 13*b*, and a pressure applying means 25 is installed within the cover 24. The pressure applying means 25 is provided with a pressure applying assembly 27 that can move vertically. The paper feed device 12 also contains a pressure applying motor 28 positioned at its center, a worm 30 provided on the drive shaft of the pressure applying motor 28, and a worm wheel 31 that is engaged with the worm 30. Further, it is provided with a transmission belt 32 passed around a pulley 31*a* coaxial with the worm wheel 31 and a drive pulley 33, and a wire 35 passed around the drive pulley 33 and a driven pulley 34 fixed away from the pulley 33. The wire 35 is fitted to the pressure applying assembly 27. The pressure applying assembly 27 is initially retired at the top dead center so that disposable papers P can be loaded on the tray 13 below it.

Figure 3:
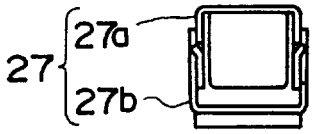
FIG. 3 is a front view of a pressure applying assembly of a pressure applying means installed in the paper feed device shown in FIGS. 1 and 2.
Figure 4:
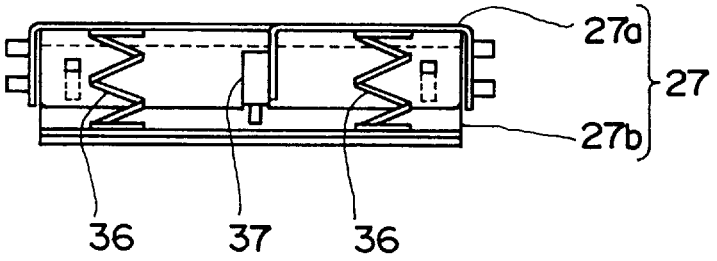
FIG. 4 is a side view in cross section of the pressure applying assembly shown in FIG. 3.
Figure 5:
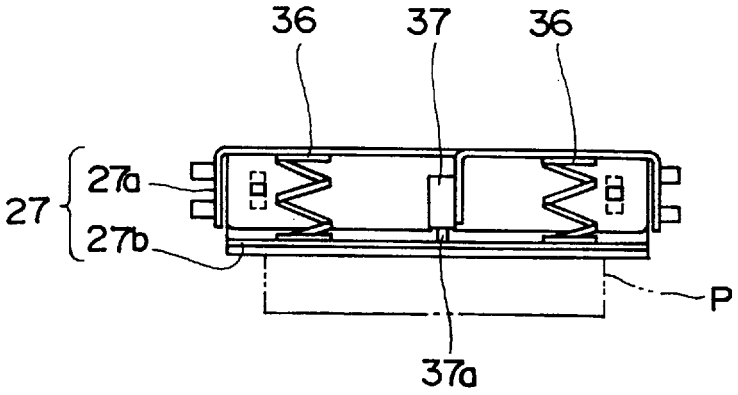
FIG. 5 is a side view of the assembly in the pressure applying condition.

The pressure applying assembly 27, as shown in FIGS. 3 and 4, consists of an upper plate 27*a* having a reversed U-shaped cross section and a lower plate 27*b* having a U-shaped cross section, the two plates 27*a* and 27*b* being installed in such a way that they can move mutually relative to each other within certain vertical limits. Located between the two plates are plural springs 36 that tend to push them apart and a pressure detection sensor 37 that is activated by the lower plate 27*b*, and they are supported by the upper plate 27*a*. The initial force of the springs 36 is set, for instance, between 3 and 5 Kg. Thus, the entire mechanism is designed in such a way that the activation of the pressure applying motor 28 is controlled by the pressure detection sensor 37 going on and off.

In other words, as the pressure applying assembly 27 presses the disposable papers P with a certain pressure, the lower plate 27*b* is pushed up against the forces of the springs 36 and turns the pressure detection sensor 37 on, which turns the pressure applying motor 28 off, thereby stopping the lowering motion of the pressure applying assembly 27. Since the pressure applying motor 28 keeps turning due to inertia for some time, the actuator 37*a* of the pressure detection sensor 37 is pushed down further within the range of over-travel. As the amount of disposable papers P decreases, the lower plate 27*b* is pressed down by the springs 36 so that the actuator 37*a* of the pressure detection sensor 37 returns to a point beyond the release position, thereby turning the sensor 37 off. This causes the pressure applying motor 28 to turn on, and the pressure applying assembly 27 lowers until the pressure detection sensor 37 becomes on again. It will be realized that the pressure applying assembly 27 is always pressing the disposable papers P within a certain constant strength, thus preventing interruption of paper feed due to the lack of necessary paper feed force.

The paper feed device 12, as shown in FIG. 1, has a front cover 39 over the front portion of and between the opposing side plates 13*a*, 13*b*, and the cover 39 is supported over the front of the opposing side plates 13*a*, 13*b* by an appropriate shaft (not shown) in such a way that it can open and close freely about it as needed to remove jammed paper, etc. Inside the front cover 39 a holder 41 made of metal is fixed to the side of the pressure applying means 25 by means of a member 41*a*.

The holder 41 is bent at the bottom in an L-shape and a restricting member 40 is fitted to its bottom. A gap g is formed between the restricting member 40 and the tray 13. Incidentally, the holder 41 is equipped with a gap adjusting mechanism (not shown) including a gap control motor, etc., which automatically moves the restricting member 40 vertically, thereby adjusting the size of gap g.

Further, the paper feed device 12 has a curved paper feed passage 43, formed near the gap g, that is, starting from the paper feed start position b and leading to the paper feed passage 10*c*, and a pair of feed rollers 44 are provided along the paper feed passage 43, and a feed roller 55 at the edge thereof.

Figure 2:
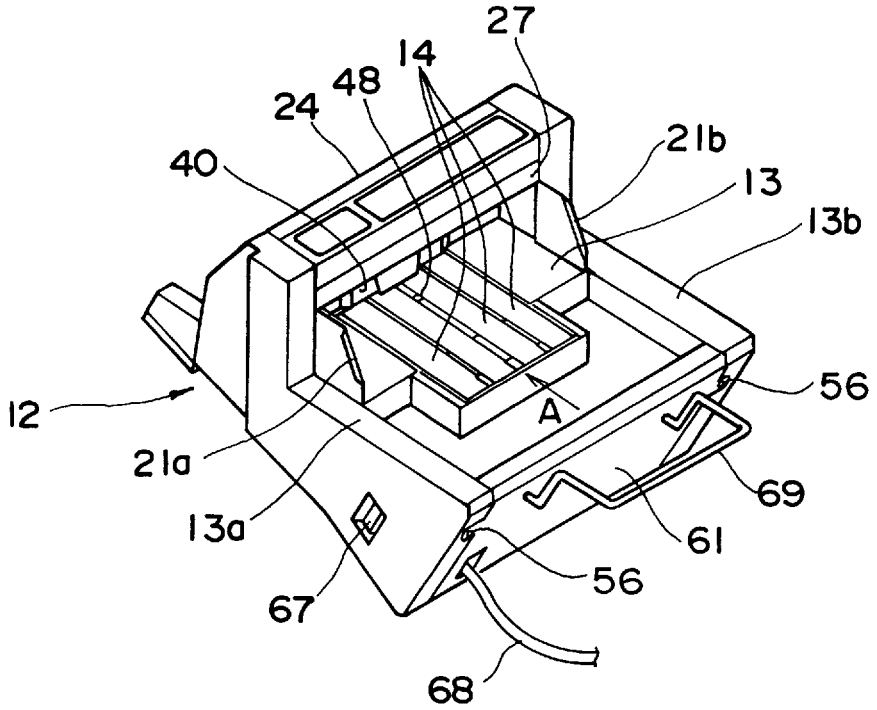
FIG. 2 is a perspective view of the paper feed device shown in FIG. 1.
Figure 6:
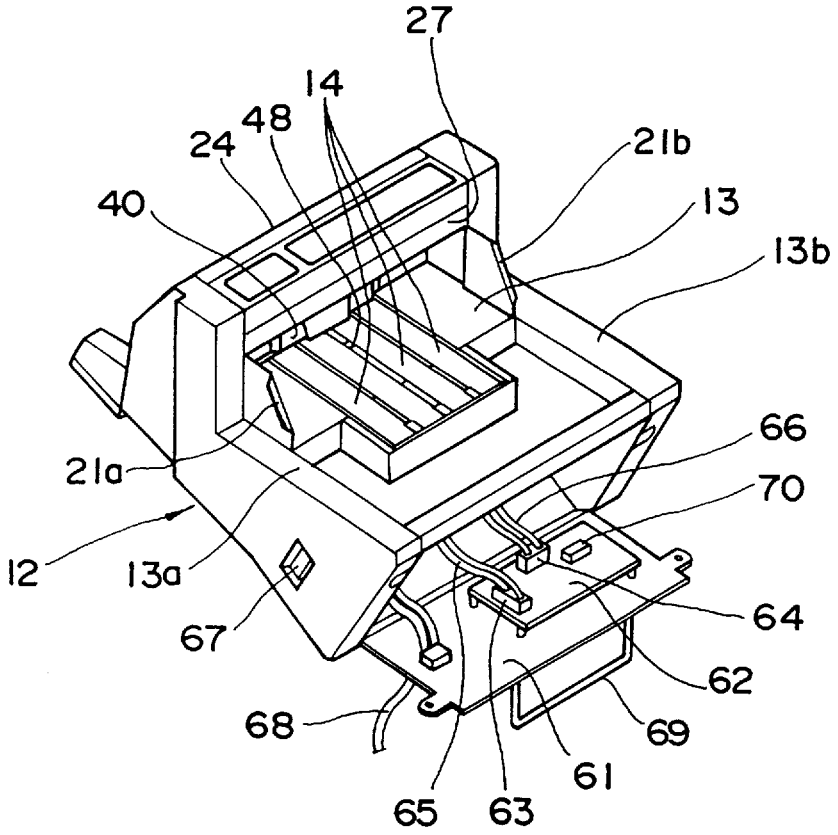
FIG. 6 is a perspective view of the paper feed device shown in FIG. 2, with its rear door opened.

On the other hand, the paper feed device 12 has screws 60 in the rear at both sides, as shown in FIG. 2, and a door 61 opens about the lower end as shown in FIG. 6 when the screws 60 are removed. A control board 62 is installed inside of the door 61. The control board 62 has connectors 63, 64 mounted thereto, to which the above-mentioned paper feed motor 17, pressure applying motor 28, pressure detection sensor 37, etc. located inside the paper feed device 12 are connected via cords 65, 66. The numeral 67 in the figure represents a main switch located on the side plate 13*a*, the numeral 68 indicates a power cord of the paper feed device 12, and the numeral 69 represents a paper guide.

A microcomputer functioning as a CPU and other components for controlling the paper feed device 12 are mounted on the control board 62. The CPU, as shown by the numeral 45 in FIG. 7, controls the driver circuit 46 that judges, for instance, whether the pressure detection sensor 37 is turned on or off and drives the pressure applying motor 28. When paper P is jammed in the paper feed passage 43, jamming is detected by a jam detection sensor 47, which, for instance, deactivates the paper feed device 12 and the shredder 10. The presence of papers P on the tray 13 is detected by a paper sensor 48, and the retreat of the pressure applying assembly 27 at the top dead center is detected by a top dead center sensor 49 so that the paper feed device 12 is controlled accordingly.

When the paper feed device 12 for shredders according to the present invention is mounted to the shredder 10 as shown in FIG. 1, an intermittent activation time adjustment means for adjusting the intermittent activation time of the paper feed mechanism 20 is also installed, taking into consideration the distance from the paper feed start position b of the paper feed mechanism 20 to the paper shredding position a of the cutter 11. The intermittent activation time adjustment means may be, for instance, a knob for adjusting the intermittent activation time, or a switch for setting the number of times the paper feed motor 17 is driven intermittently, and they are installed in such a way that they can be adjusted.

The paper feed device 12 of this invention has a drive control means in the CPU 45. When the paper feed device 12 is activated, the paper feed mechanism 20 is initially driven only intermittently. After an elapse of time as adjusted by the intermittent activation time adjustment means, it is switched and activates the paper feed mechanism 20 continuously.

The intermittent activation time adjustment means in the paper feed device 12 for shredders of the present invention may be implemented by a DIP switch 70 mounted, for instance, to the control board 62 as shown in FIG. 6. The time for intermittently activating the paper feed mechanism 20 is adjusted by intermittently activating the paper feed mechanism 20 for the number of times set by the DIP switch 70.

Figures 8, 9:
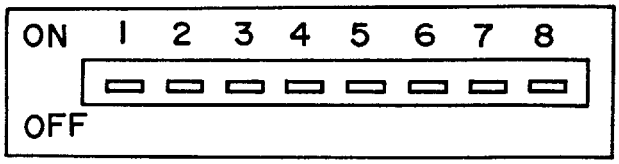
FIG. 8 is a front view of a DIP switch installed in the paper feed device.
FIG. 9 is a table showing the relationship between ON settings of switches of the DIP switch and the number of intermittent activation of the paper feed mechanism.

For instance, a DIP switch 70, as shown in FIG. 8, may be used and the switches 1 to 8 may be set to the on or off position individually as necessary so that the number of times the paper feed mechanism 20 is activated intermittently, for instance, once, three times, five times, etc., can be set freely by the combination of the on and off position settings of the switches 1 to 8. For instance, as shown in FIG. 9, the number of times of intermittent activation may be set to zero by setting all the switches 1 to 4 in the off position, to one when only the switch 1 is set in the on position and switches 2 to 4 are set in the off position, to two when only the switch 2 is set in the on position and switches 1, 3, and 4 are set in the off position, or to three when the switches 1 and 2 are set in the on position and the switches 3 and 4 are set in the off positions, etc., regardless of the on and off positions of other switches 5 to 8.

In the paper feed method according to the present invention disposable papers P are fed automatically to the shredder 10 using the above-mentioned paper feed device 12. The paper feed device 12 is first installed on the shredder 10. At the same time, the intermittent activation time adjustment means is adjusted, taking into consideration the distance from the paper feed start position b of the paper feed mechanism 20 of the paper feed device 12 to the paper shredding position a of the cutter 11 of the shredder 10, and is switched to continuous activation preferably immediately before the leading edge of the paper reaches the cutter 11. Then, disposable papers P are loaded and set in place on the tray 13 of the paper feed device 12. Further, the side guides 21 are moved according to the width of the disposable papers P until they are touching the sides of the disposable papers P.

At this time, the main switch 67 is turned on and the start switch, not shown, is pushed to activate the paper feed device 12. Then, the paper feed mechanism 20 is activated intermittently by a drive control means so that disposable papers P are fed intermittently and sequentially to the shredder 10 using the paper feed mechanism 20. Then, after an elapse of time as adjusted by the intermittent activation time adjustment means, the paper feed mechanism 20 is switched and activated continuously by the drive control means so that the disposable papers P are fed continuously and sequentially to the shredder 10 using the paper feed mechanism 20.

When the paper feed device 12 is installed to the shredder 10 to shred disposable papers P, the door 61 is opened by removing the screws 60 shown in FIG. 2, and the number of intermittent activation of the paper feed mechanism 20 is set by setting the switches 1 to 4 of the DIP switch 70 to the on or off positions as needed, taking into consideration the distance from the paper feed start position b of the paper feed mechanism 20 of the paper feed device 12 to the paper shredding position a of the cutter 11 of the shredder 10. Then, the door 61 is closed and held in place with the screws 60 after adjusting activation timing so that continuous activation is switched on preferably immediately before the leading edge of the paper reaches the cutter 11. Then, disposable papers P are set and start switch is depressed. As shown in the flowchart in FIGS. 10A and 10B, the number of intermittent paper feed is recognized by the DIP switch 70 in Step S0. Then, Step S1 judges whether the start switch is turned on or not, and when it is judged not on, Step S1 is repeated until the start switch is on. When it is judged on, Step S2 judges whether there is paper P on the tray 13 using a paper sensor 48. When judged negatively, the process returns to Step S1. When judged positively, the process proceeds to next step, Step S3.

In Step S3, the pressure applying motor 28 is activated to lower the pressure applying assembly 27, and the process proceeds to Step S4. In Step S4, the pressure detection sensor 37 judges whether the pressure applying assembly 27 is pressing the loaded papers P. When judged negatively. Step S4 is repeated. When judged positively, the process proceeds to Step S5 and the pressure applying motor 28 is turned off to stop the lowering motion of the pressure applying assembly 27. Then, in Step S6, the paper feed motor 17 is turned on and the feed belts 14 are started, thereby starting to feed papers from the paper feed start position.

Now, in the next step, Step S7, the intermittent activation counter is reset to 0 and the process proceeds to Step S8. Step S8 judges whether N seconds have elapsed after the paper feed motor 17 was turned on. When judged negatively, Step S8 is repeated. When judged positively, the process proceeds to Step S9 and the paper feed motor 17 is turned off to stop paper feed. Then, the next step, Step S10, judges whether M seconds have elapsed after the paper feed motor 17 was turned off. When judged negatively, Step S10 is repeated. When judged positively, the process proceeds to Step S11 and the paper feed motor 17 is turned on again to feed paper P, and the process proceeds to Step S12.

Then, the intermittent activation counter is incremented by 1 in Step S12, and the intermittent activation counter is checked in Step S13 to verify the number of times the paper feed motor 17 has repeated the intermittent activation. When the predetermined number (3, for instance) has not been reached, the process returns to Step S8 and is repeated until 3, for instance, is reached. The intermittent activation is repeated to decrease the speed at which the leading edge of paper P passes the paper detection sensor position a and reaches the cutter 11. Then, when the predetermined number is reached, the intermittent activation of the paper feed motor 17 is ended, and the intermittent activation counter is reset to 0 in Step S14. This is followed by continuous paper feed.

On the other hand, the cutter 11 is activated when the leading edge of paper P is detected by the paper detection sensor 56 at the paper detection sensor position a. Then, the continuously fed paper is shredded sequentially by the cutter 11 and the shreds are compressed, though not shown, for disposal.

Figure 10A:
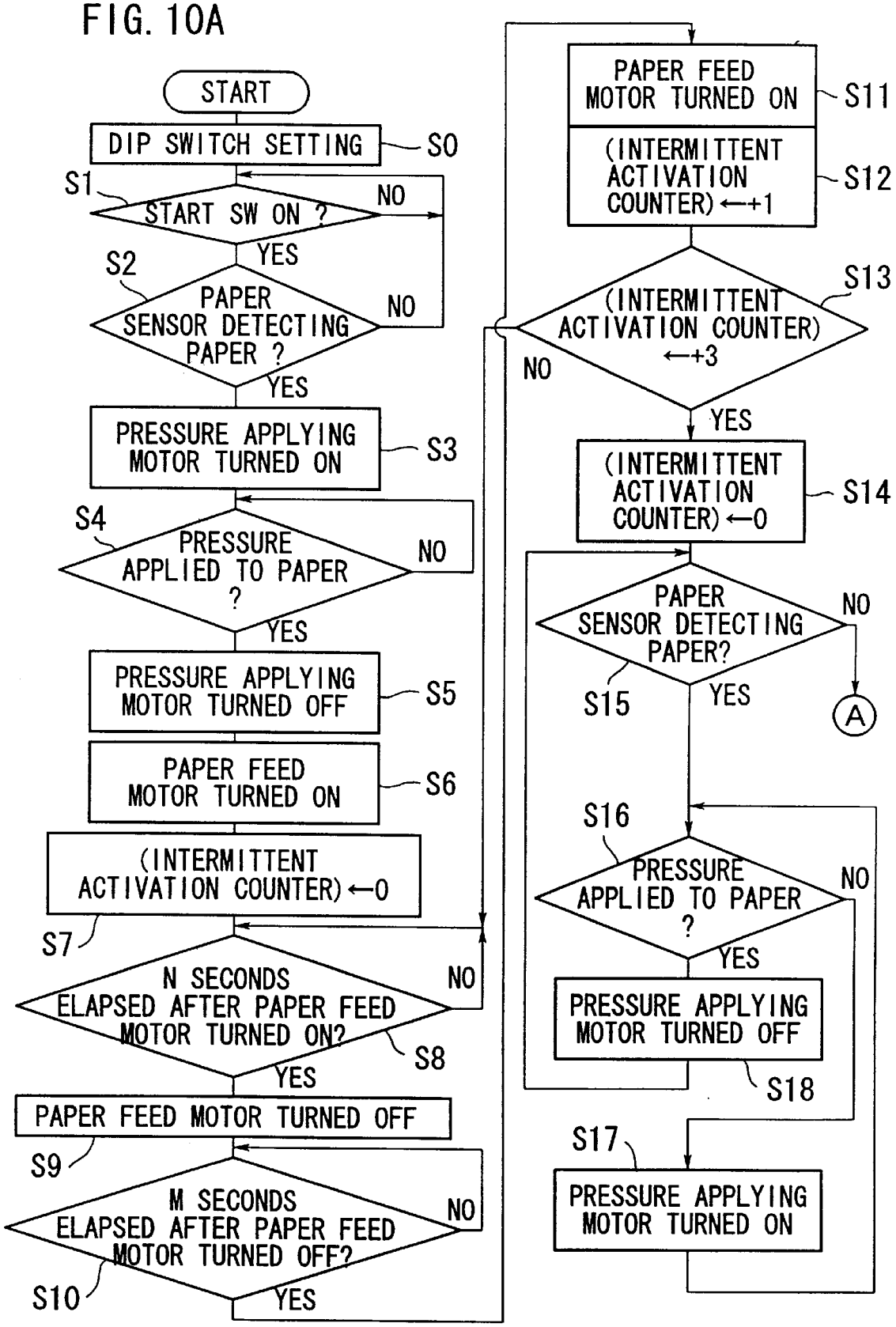
FIGS. 10A and 10B are flowcharts of shredding disposable papers using a shredder to which the paper feed device shown in FIG. 2 is mounted.
Figure 10B:
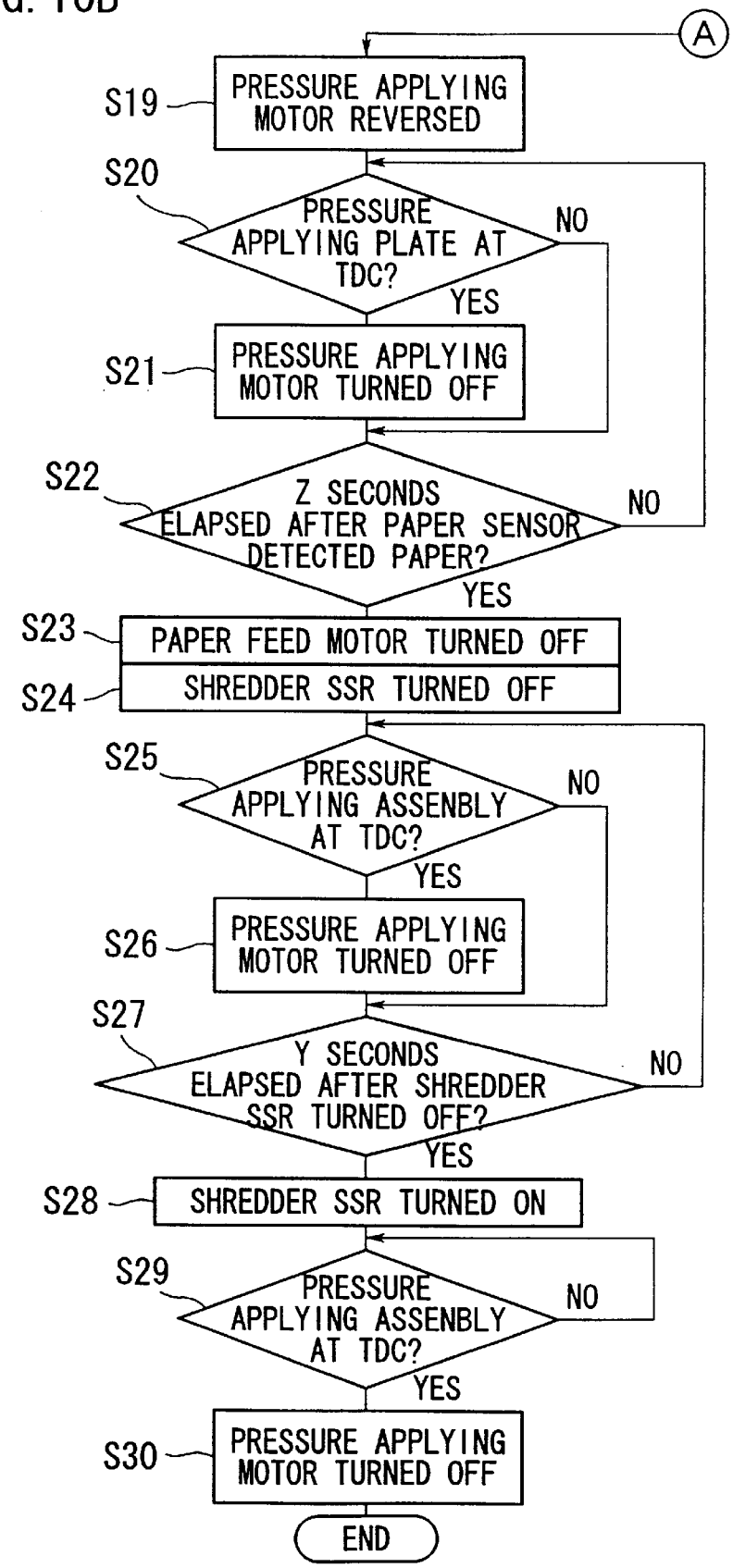

During continuous paper feed, Step S15 judges, as shown in Figures 10A and 10B, and using the paper sensor 48, whether all of the papers P on the tray 13 have been fed. When paper P is judged to be remaining, the next step, Step S16, judges, using the pressure detection sensor 37, whether the pressure applying assembly 27 is applying pressure to the loaded papers P, an when judged negatively, the process proceeds to Step S17 where the pressure applying motor 28 is activated, so that Steps S16 and S17 are repeated until Step S16 judges the pressure applying state. When the sensor judges the pressure applying state, the process proceeds to Step S18 where the pressure applying motor 28 is deactivated and Step S15 and next steps are repeated, maintaining the continuous paper feed, until Step S15 judges the absence of paper.

When Step S15 judges the absence of paper, the process proceeds to Step S19 to stop paper feed, as explained hereunder.

Step S19 activates the pressure applying motor 28 in reversed direction of rotation to raise the pressure applying assembly 27, and Step S20 judges whether the pressure applying assembly 27 is at the top dead center using the top dead center sensor 49. When judged positively, Step S21 deactivates the pressure applying motor 28, and, when judged negatively, the process proceeds to Step S22 keeping the pressure applying motor 28 in the activated condition. Then, Step S22 judges whether Z seconds have elapsed after the absence of paper was judged by the paper sensor 48, and, when judged negatively, Steps S20, 21, and 22 are repeated. When judged positively, the next step, Step S23, deactivates the paper feed motor 17 and, further, Step S24 deactivates the SSR (solid-state relay) 53 for shredders.

Then, the next step, Step S25, judges again whether the pressure applying assembly 27 is at the top dead center using the top dead center sensor 49, and, when judged positively, Step S26 deactivates the pressure applying motor 28, and, when judged negatively, the process proceeds to Step S27 while keeping the pressure applying motor 28 in the activated condition. Then, Step S27 judges whether Y seconds have elapsed after the SSR 53 was turned off, and, when judged negatively, Steps S25, S26, and S27 are repeated. When judged positively, the next step, Step S28, turns the SSR 53 on and, further, Step S29 judges again, using the top dead center sensor 49, whether the pressure applying assembly 27 is at the top dead center. When judged negatively, Step S29 is repeated while keeping the pressure applying motor 28 in the activated condition, and, when judged positively, the next step, Step S30, deactivates the pressure applying motor 28 and completes the paper feed stop process.

In actual use, paper feed may be suspended because the shredder 10 is full or for other reasons. If operation is resumed for example after removing the shreds, paper which is stopped in the way of being fed may start to move. In such case, intermittent feed may be continued even after the leading edge of paper reaches the cutter 11, and the leading edge of paper may be caught between the teeth of the cutter 11 during the intermittent deactivation condition, causing objectionable noise or vibration in the paper feed device 12.

The paper feed device according to the another aspect of the present invention has a cutter activation detection means that detects the activation of the cutter 11, and is designed in such a way that the paper feed mechanism 20 is switched from intermittent to continuous activation by an activation control means when the activation of the cutter 11 is detected by the cutter activation detection means.

Figure 7:
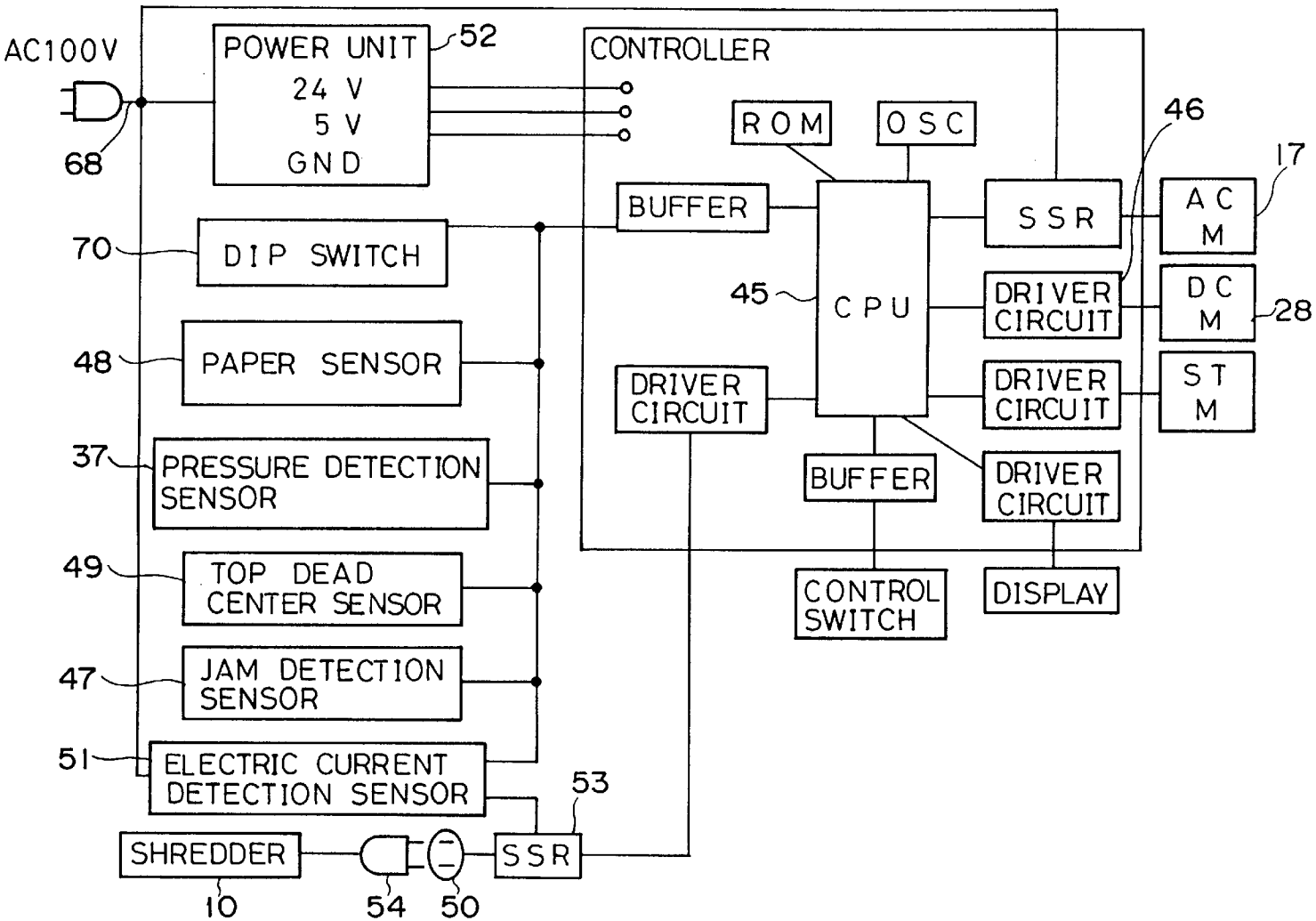
FIG. 7 is a block diagram showing an electrical structure of the paper feed device.

The paper feed device according to the present invention as shown in FIG. 7, a power plug 54 of the shredder 10 is connected to the plug socket 50 for shredders of the paper feed device 12, thereby supplying 100V AC electricity to the shredder 10 by way of the plug socket 50 for shredders. In addition, the electric current detection sensor 51 is used as the means of cutter activation detection means, and the current consumption of the shredder 10 is detected by the electric current detection sensor 51, thereby allowing judgment of the operation of the shredder 10 on the basis of the output voltage of the electric current detection sensor 51.

Figure 11:
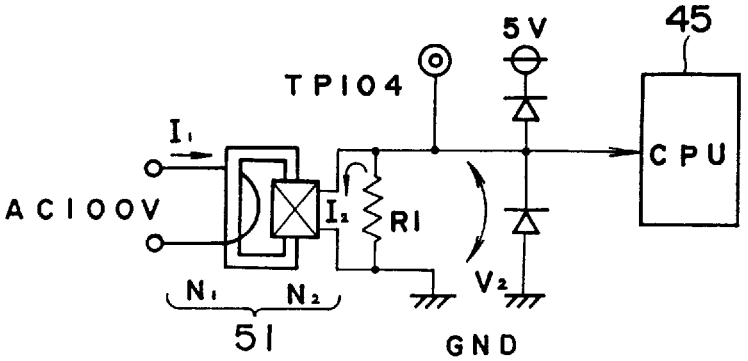
FIG. 11 is a wiring diagram of an electric current detection sensor installed in the paper feed device in FIG. 2.
Figure 12:
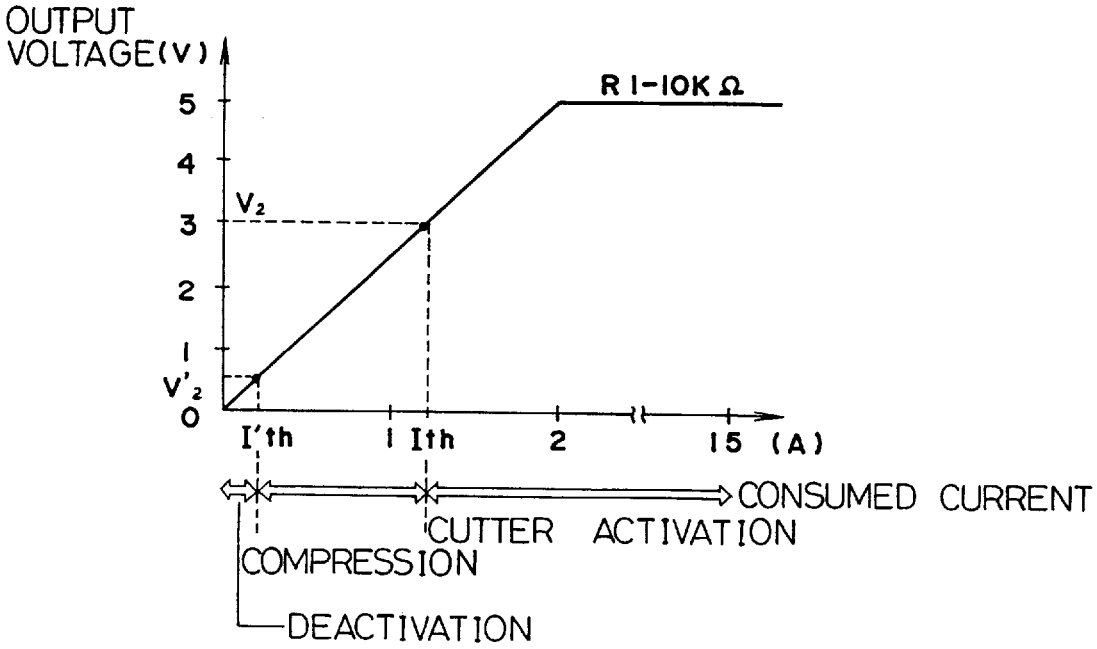
FIG. 12 is a graph showing an output characteristics of the electric current detection sensor.

In other words, the electric current detection sensor 51 detects electric current consumed by the shredder 10 by means of the plug socket 50 for shredders, so that the CPU 45 can judge, on the basis of the outlet voltage, the activation condition of the shredder 10 that may be cutter activation, compression, or deactivation. For this purpose, and as shown in FIG. 11, for instance, the electric current detection sensor 51 has a resistance R1 in the secondary side and is designed in such a way so that any change in the AC current $I_1$in the primary side (consumed current, primary current) is converted into DC voltage $V_2$that can be handled more easily by the CPU 45. When 10 kΩ is connected to the resistance RI, for instance, the output voltage $V_2$ of the electric current detection sensor 51 changes as shown in the graph in FIG. 12. On the other hand, the electric currents consumed by the shredder 10 for cutter activation, shred compression, and cutter deactivation generally take the values shown in FIG. 13A. The threshold values for those conditions may be set respectively as shown, for instance, in FIG. 13B. The threshold value Ith for the cutter activation is more than 1.2A, and the output voltage $V_2$ in that condition is 3V DC as shown in FIG. 12. Consequently, when the output voltage of the electric current detection sensor 51 is 3V DC or larger, it may be judged by the CPU 45 that the cutter 11 is in the activated condition.

Now, in the paper feed method according to the another aspect of the present invention, disposable papers are fed automatically to the shredder 10 using the above-mentioned paper feed device 12. First, the paper feed device 12 is installed on the shredder 10, then disposable papers P are loaded and set in place on the tray 13 thereof, and then retained in place by side guides 21 at both sides.

Then, the paper feed device 12 is started, for instance, by pressing a start switch, and the paper feed mechanism 20 is activated intermittently by an activation control means so that disposable papers P are fed sequentially and intermittently to the shredder 10. Then, when the paper detection sensor 56 of the shredder 10 detects the paper and the cutter 11 of the shredder 10 is activated accordingly, the activation of the cutter 11 is detected by the cutter activation detection means of the paper feed device 12. Then, the paper feed mechanism 20 is switched when the activation of the cutter 11 is detected by the cutter activation detection means, and is then activated continuously so that disposable papers P are fed sequentially and continuously to the shredder 10. Switching is set so that continuous activation is switched preferably immediately before the leading edge of the paper reaches the cutter 11.

Figure 14A:
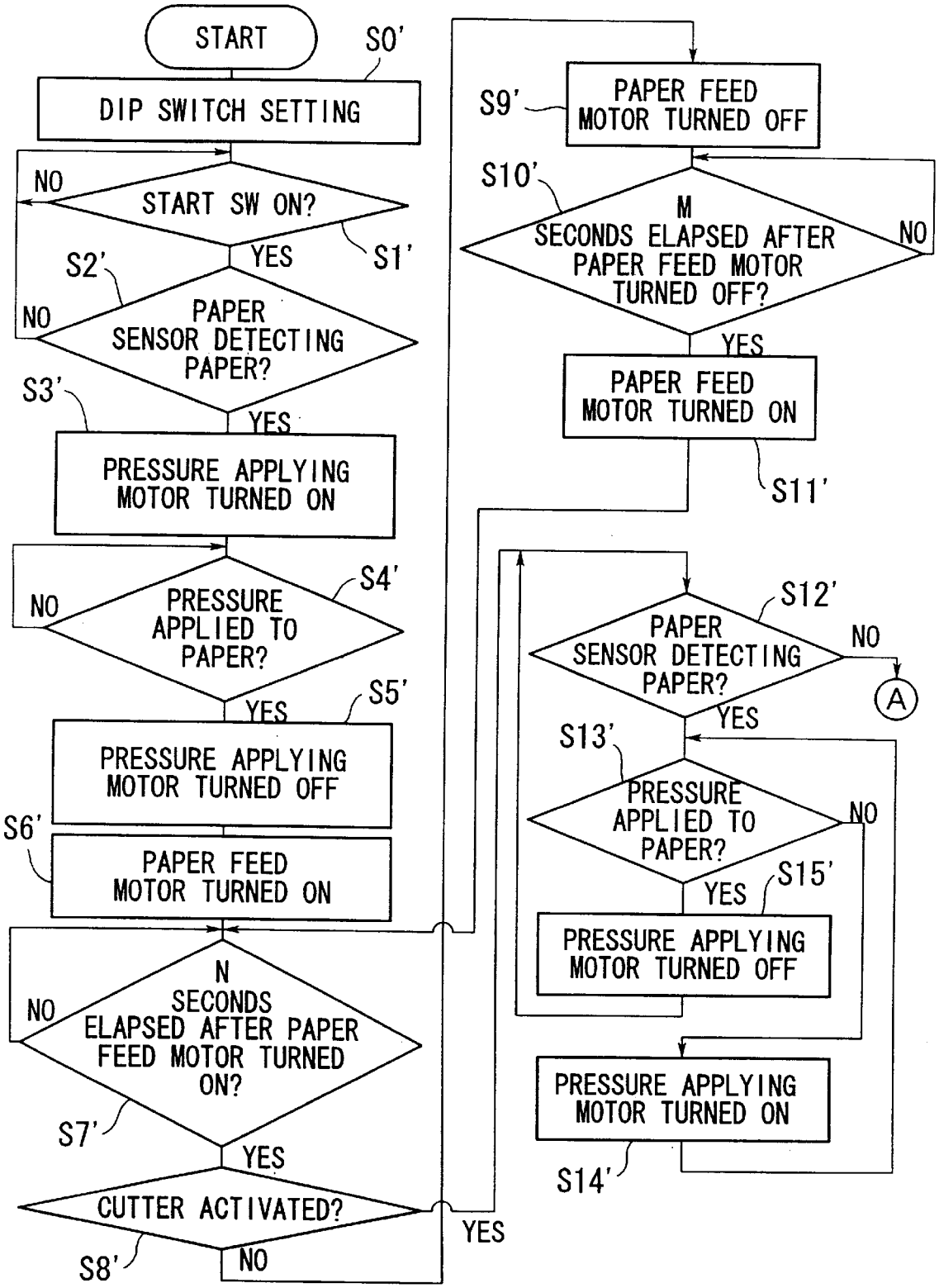
FIGS. 14A and 14B are flowcharts of shredding disposable papers using a shredder to which the paper feed device of this invention shown in FIG. 2 is attached.
Figure 14B:
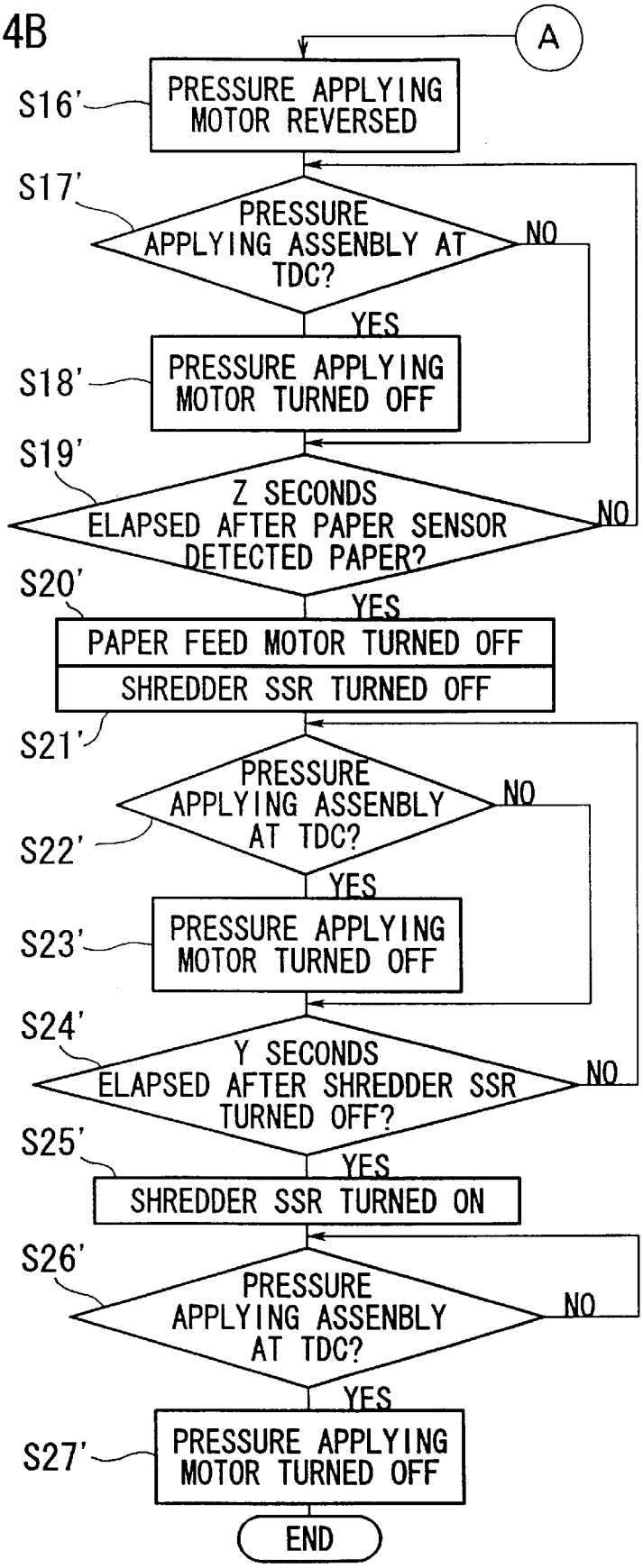
Figure 15:
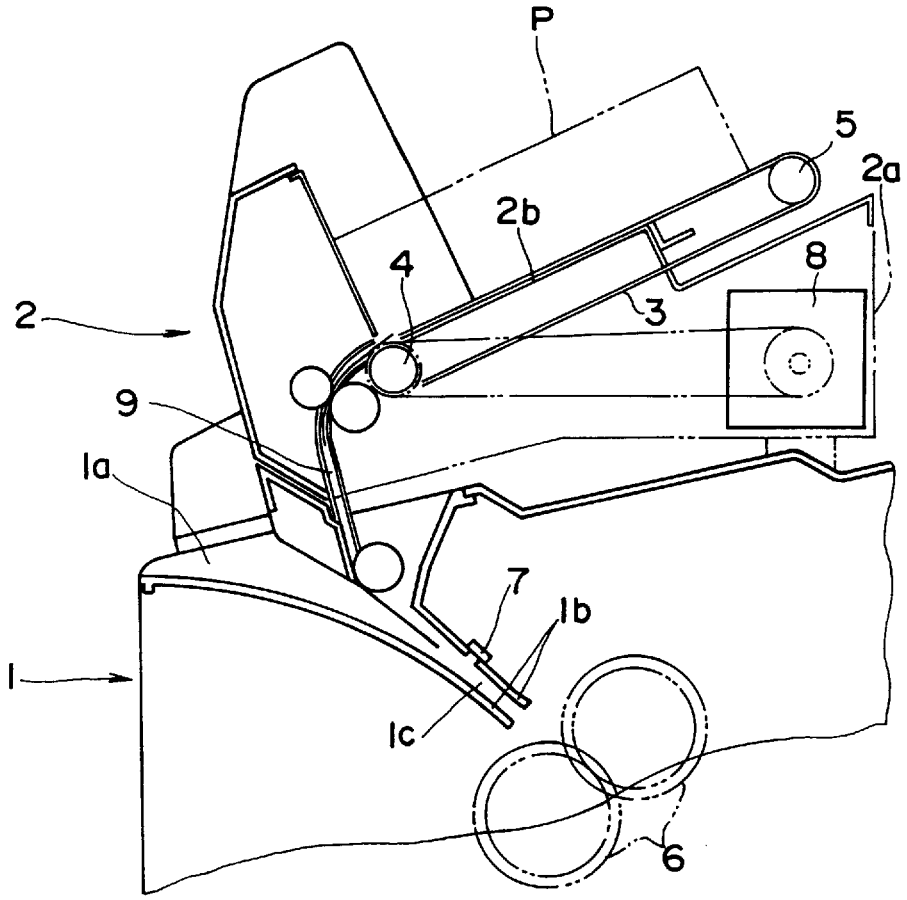
FIG. 15 is a schematic view showing an inner structure of the upper portion in a shredder to which a conventional paper feed device is attached.

When the paper feed device, for instance, is attached to the shredder 10 for shredding disposable papers P, the process until the start switch is pressed and the paper feed motor 17 is turned on (Steps S0' to S6' in FIG. 14A), as shown in the flowchart shown in FIGS. 14A and 14B, is identical to the process using the paper feed device 12 shown in and explained with reference to FIGS. 10A and 10B.

Now Step S7' judges if N seconds have elapsed after the paper feed motor 17 was turned on. When judged negatively, Step S7' is repeated. When judged positively, the process proceeds to Step S8'. Then, Step S8' detects, using the electric current detection sensor 51, whether the cutter 11 is activated. When the CPU 45 judges negatively, the next step, Step S9', deactivates the paper feed motor 17 to put the process in paper feed stop condition, and the process proceeds to the next step, Step S10'. Step S10' judges whether M seconds have elapsed after the paper feed motor 17 was turned off, and, when judged negatively, Step S10' is repeated, and, when judged positively, the process proceeds to Step S11' and the paper feed motor 17 is turned on and the process returns to Step S7'. Then, Steps S7' to S1' are repeated until activation of the cutter 11 is judged by Step S8'. Thus, the intermittent activation of the paper feed motor 17 is repeated to decrease the speed at which the leading edge of paper P passes the paper detection sensor position a and reaches the cutter 11.

On the other hand, when the cutter 11 is judged to be activated in Step S8', the intermittent activation is ended and the process proceeds to Step S12' for continuous paper feed. Step S12' to S15' are repeated for continuous paper feed until the absence of paper is judged by the paper sensor 48 in Step S12', as is also the case in the implementation shown in Figures 10A and 10B. Thus, when the absence of paper is judged, paper feed control is ended after a similar paper feed stopping operation in Step S16' to S27'.

In the invention as explained above, the intermittent activation time adjustment means can be adjusted at the time the paper feed device is attached to a specific shredder, taking into consideration the distance from the paper feed start position of the paper feed mechanism of the paper feed device to the paper shredding position of the cutter of the shredder, and, after an elapse of time as adjusted by the intermittent activation time adjustment means, activation of the paper feed mechanism by the activation control means is switched from intermittent to continuous activation preferably immediately before the leading edge of the paper reaches the cutter of the shredder. This decreases the speed of the paper from the time it is detected by the paper detection sensor to the time it reaches the paper shredding position, thus preventing the leading edge of the paper from reaching the cutter before the cutter is fully activated, thereby preventing paper feed troubles associated with conventional devices, due to paper jamming, etc., caused by bending of the paper, etc.

In the invention according to the another aspect of the present invention, activation of the paper feed mechanism is switched by the activation control means when the cutter activation is detected by the cutter activation detection means, so that activation is switched from intermittent to continuous operation preferably immediately before the leading edge of the paper reaches the cutter of the shredder. This prevents the leading edge of the paper from reaching the cutter before the cutter is fully activated, thereby preventing paper feed troubles associated with conventional devices, due to paper jamming, etc., caused by bending of the paper, etc. Further, since continuous activation is switched on only when the cutter activation is detected, this also prevents problems involving noise or vibration of the paper feed device occurring when the leading edge of paper is caught between the teeth of the cutter.

What is claimed is:

1. A paper feed device for a shredder for disposable paper, comprising:

a cutter a paper feed means;

a paper detection sensor that detects paper and activates the cutter which then shreds the paper, the paper feed device being activated after disposable paper is loaded and set in place and feeding paper sequentially to the shredder by the paper feed means;

a cutter activation detection means that detects activation of the cutter; and an activation control means that first intermittently activates the paper feed means and then switches and activates the paper feed means continuously when activation of the cutter is detected by the cutter activation detection means.

2. The paper feed device for a shredder for disposable paper according to claim 1, further comprising a plug socket for the shredder that supplies electricity to the shredder, and an electric current detection sensor, as a means to detect activation of the cutter, which detects current consumption of the plug socket for the shredder.

3. A paper feed method using a paper feed device for a shredder for disposable paper comprised of:

a cutter a paper feed means;

a paper detection sensor that detects paper and activates the cutter which then shreds the paper, the paper feed device being activated after disposable paper is loaded and set in place and feeding paper sequentially to the shredder by the paper feed means; a cutter activation detection means that detects activation of the cutter; and activates the cutter which then shreds the paper, the paper feed device being activated after disposable paper is loaded and set in place and feeding paper sequentially to the shredder by the paper feed means; a cutter activation detection means that detects activation of the cutter; and an activation control means that first intermittently activates the paper feed means and then switches and activates the paper feed means continuously when activation of the cutter is detected by the cutter activation detection means, the paper feed method comprising:

a. mounting the paper feed device to the shredder for automatically feeding the disposable paper to the shredder;

b. loading and setting disposable paper in place in the paper feed device;

c. activating the paper feed device to activate the activation control means thereof to drive the paper feed means intermittently to sequentially feed the disposable paper to the shredder;

d. subsequently detecting cutter activation by the cutter activation detection means of the paper feed device when the fed paper is detected by the paper detection sensor of the shredder and the cutter of the shredder is activated;

e. switching on the paper feed device to continuously activate the paper feed means using the activation control means, when the activation of the cutter is detected by the cutter activation detection means;

f. cutting the paper; and g. continuously feeding and cutting the disposable paper sequentially to the shredder.

* * * * *